US010918257B2

(12) United States Patent
Gubenko et al.

(10) Patent No.: US 10,918,257 B2
(45) Date of Patent: Feb. 16, 2021

(54) SPONGE MOP

(71) Applicant: Carl Freudenberg KG, Weinheim (DE)

(72) Inventors: Leo Gubenko, Winfield, IL (US); Omar Betouni, Tinley Park, IL (US); Thomas J. Caruso, Streamwood, IL (US)

(73) Assignee: Carl Freudenberg KG, Weinheim (DE)

( * ) Notice: Subject to any disclaimer, the term of this patent is extended or adjusted under 35 U.S.C. 154(b) by 37 days.

(21) Appl. No.: 16/372,631

(22) Filed: Apr. 2, 2019

(65) Prior Publication Data

US 2020/0315422 A1 Oct. 8, 2020

(51) Int. Cl.
*A47L 13/144* (2006.01)
*A47L 13/257* (2006.01)

(52) U.S. Cl.
CPC ..... *A47L 13/257* (2013.01); *A47L 13/144* (2013.01)

(58) Field of Classification Search
CPC ..... A47L 13/144; A47L 13/257; A47L 13/60
See application file for complete search history.

(56) References Cited

U.S. PATENT DOCUMENTS 4,908,901 A * 3/1990 Torres ..... A47L 13/144 15/119.1
RE36,635 E 4/2000 Vosbikian et al.
RE37,415 E 10/2001 Petner
2016/0242616 A1* 8/2016 Juergens ..... A47L 13/24

* cited by examiner

*Primary Examiner* — Randall E Chin
(74) *Attorney, Agent, or Firm* — Leydig, Voit & Mayer, Ltd.

(57) ABSTRACT

An insert for a mop includes a rail and a cleaning element at least partially disposed in an internal channel of the rail. Two protrusions are disposed on the body, each forming a leg connected to the body and a cylindrical wall defining an actuation bore connected to the leg. Each actuation bore is adapted to overlap a substantial portion of a tine, the tine being associated with a sponge mop having a hand lever that operates to pull the tine, the tine being disposed in the actuation bore and configured to impart a force onto the body through the actuation bore to pull the rail and the cleaning element through a set of rollers to wring out fluids that may be present in the cleaning element.

14 Claims, 4 Drawing Sheets

SPONGE MOP

BACKGROUND OF THE INVENTION

Sponge mops are a type of mop that uses a sponge as its cleaning element. During a cleaning operation, the sponge may be wetted in a cleaning solution before being moved along a floor surface to be cleaned. When the sponge becomes soiled, it may be rinsed in a cleaning solution and wrung to remove excess solution before resuming a cleaning operation.

In the past, various mechanisms for wringing a sponge cleaning element on a mop have been proposed. For example, U.S. RE36, 635 to Vosbikian describes a sponge mop in which the sponge mopping head is foldable for wringing and storage. However, the folding of the sponge each time wringing is desired, and also while stored, may create creases in the mop and compromise its shape and, thus, effectiveness in cleaning a floor.

Another example of a wringing mechanism can be seen in U.S. RE37, 415 to Petner, in which two rollers disposed at a distance and in parallel to one another squeeze cleaning solution through an elongate mop head as the mop head is retracted between the rollers. For retracting the sponge, the sponge is connected to an elongate structure, which is in turn fastened to a retractable actuator bar with two screws (see FIG. 13). While this wringing mechanism does not create creases or other shape effects on the mop head, retraction of the actuator bar places stress on the fasteners, which may sometimes fail. Moreover, when the sponge has been worn and requires replacement, the fasteners may be difficult to remove due to accumulation of debris and corrosion, since their placement in close proximity to the sponge exposes them to constant wetting from the cleaning solution used while operating the mop.

BRIEF SUMMARY OF THE INVENTION

In one aspect, the present disclosure describes an insert for a mop. The insert includes a rail having a body, the body having an elongate shape and forming an internal channel, and a cleaning element at least partially disposed in the internal channel in engaged relation with the body, wherein the cleaning element is made from one or more sponge materials disposed within the internal channel and extending therefrom. Two protrusions are disposed on the body. Each of the two protrusions forms a leg connected to the body and a cylindrical wall defining an actuation bore connected to the leg. Each actuation bore is adapted to overlap a substantial portion of a tine, the tine being associated with a sponge mop having a hand lever that operates to pull the tine, the tine being disposed in the actuation bore and configured to impart a force onto the body through the actuation bore to pull the rail and the cleaning element through a set of rollers to wring out fluids that may be present in the cleaning element.

BRIEF DESCRIPTION OF THE SEVERAL VIEWS OF THE DRAWING(S)

DETAILED DESCRIPTION OF THE INVENTION

Figure 2:
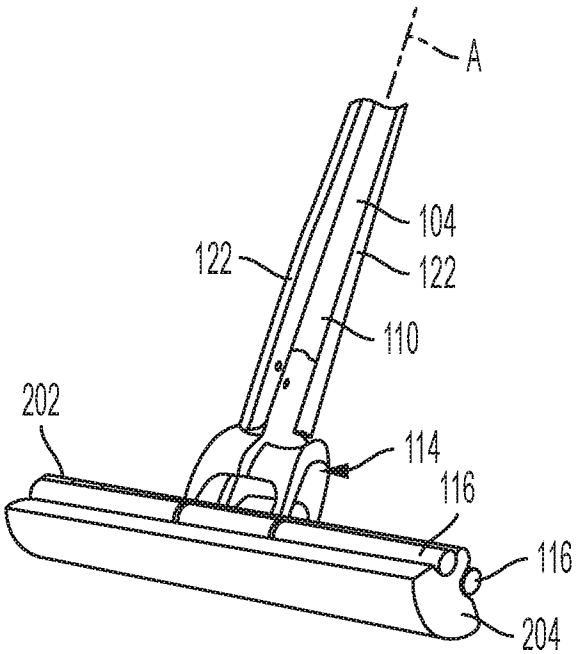
FIG. 2 is an enlarged portion of the mop of FIG. 1.

The present disclosure is directed to a sponge mop insert and, more particularly, to an improved retention structure for attaching the sponge mop insert to a sponge mop. A sponge mop 100 having a typical configuration that includes an improved insert 102 in accordance with the disclosure is shown in FIG. 1, with an enlarged detail view shown in FIG. 2 and also in FIG. 3, where an intermediate position of the insert 102 is shown during assembly or disassembly thereof relative to the mop 100.

In reference to these figures, the mop 100 includes a handle 104 having an elongate shape. When oriented during use, the handle includes a top end 106, which may include a finial 108, and a bottom end 110. A receptacle 114 is attached to the bottom end 110 of the handle 104. The receptacle includes two sets of rollers 116 that have an elongate shape and are disposed parallel to one another at a distance. The rollers 116 are disposed to rotate about axes B1 and B2 that are disposed at a distance, d, from one another and are both perpendicular to a longitudinal axis A of the handle 104. A hand lever 118 is pivotally attached to the handle 104 at a pivot 120 disposed at a longitudinal location along the handle 104 between the top end 106 and the bottom end 110. A pair of pull bars 122 are pivotally attached at one end onto the hand lever 118 but at an offset distance from the pivot 120. The pair of pull bars 122 extends down from the hand lever 118 and into the receptacle 114.

Figure 3:
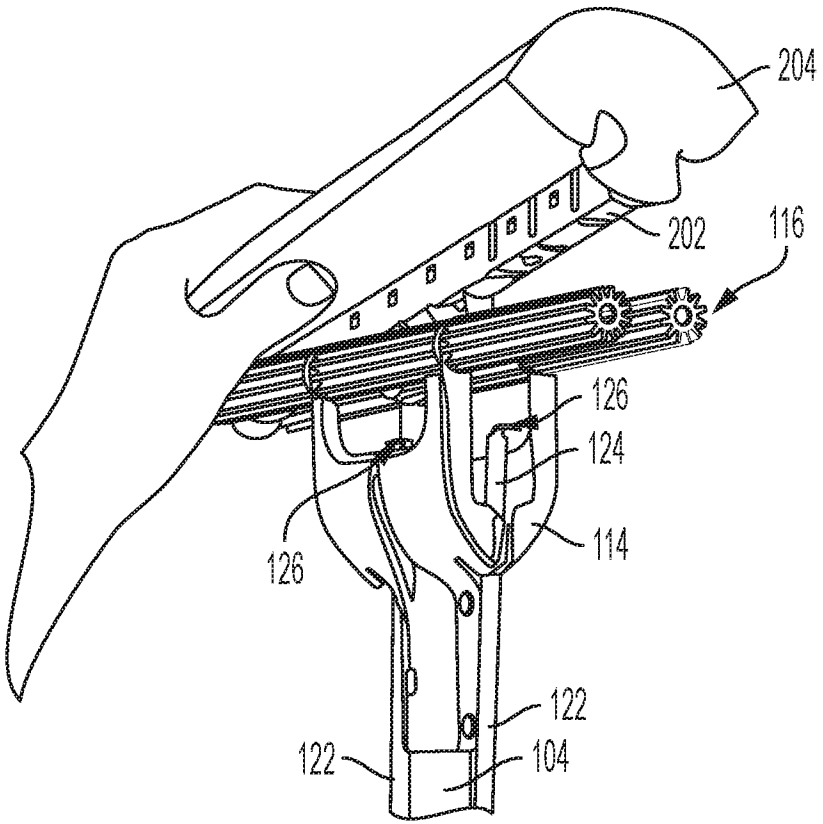
FIG. 3 is a partial view of a mop refill during installation or removal in accordance with the disclosure.

When a user grips and rotates the hand lever 118 upward relative to the handle 104, the pair of pull bars 122 is pulled upward and thus retracts relative to the receptacle 114. At their bottom end, each of the pair of pull-bars 122 includes a straight portion 124 that terminates on its free end with an actuator tine 126, as shown in FIG. 3. As can be seen in FIG. 3, the tine 126 extends generally perpendicularly relative to the straight portion 124 in a direction away from the longitudinal axis A of the handle 104. This orientation is the same for both tines 126 such that, as can be seen in FIG. 3, the two tines 126 extending from the pair of pull-bars 122 extend away from one another, and are disposed within the receptacle 114.

Figure 1:
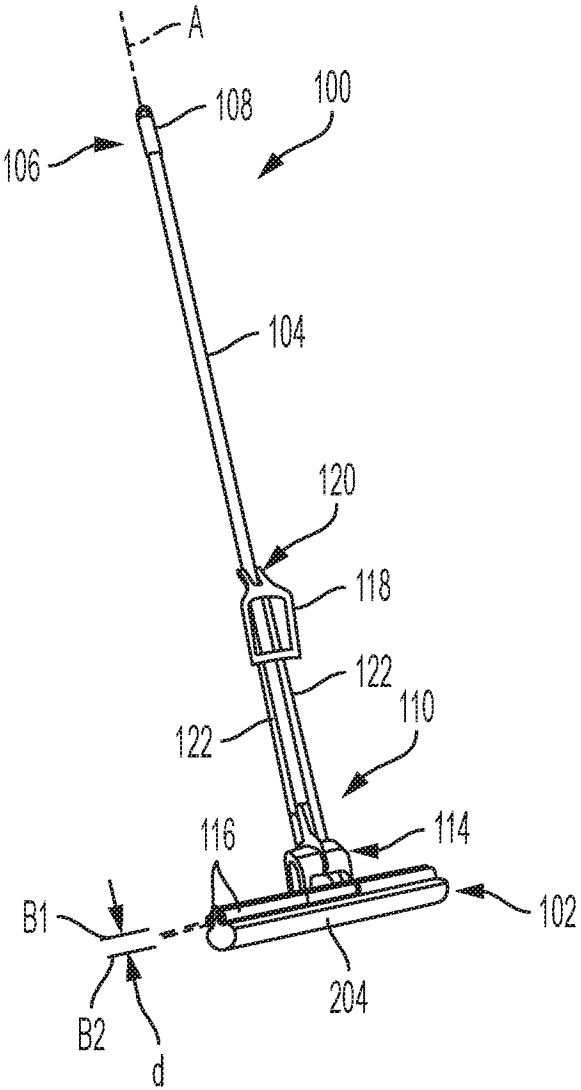
FIG. 1 is an outline view of a mop in accordance with the disclosure.
Figure 4:
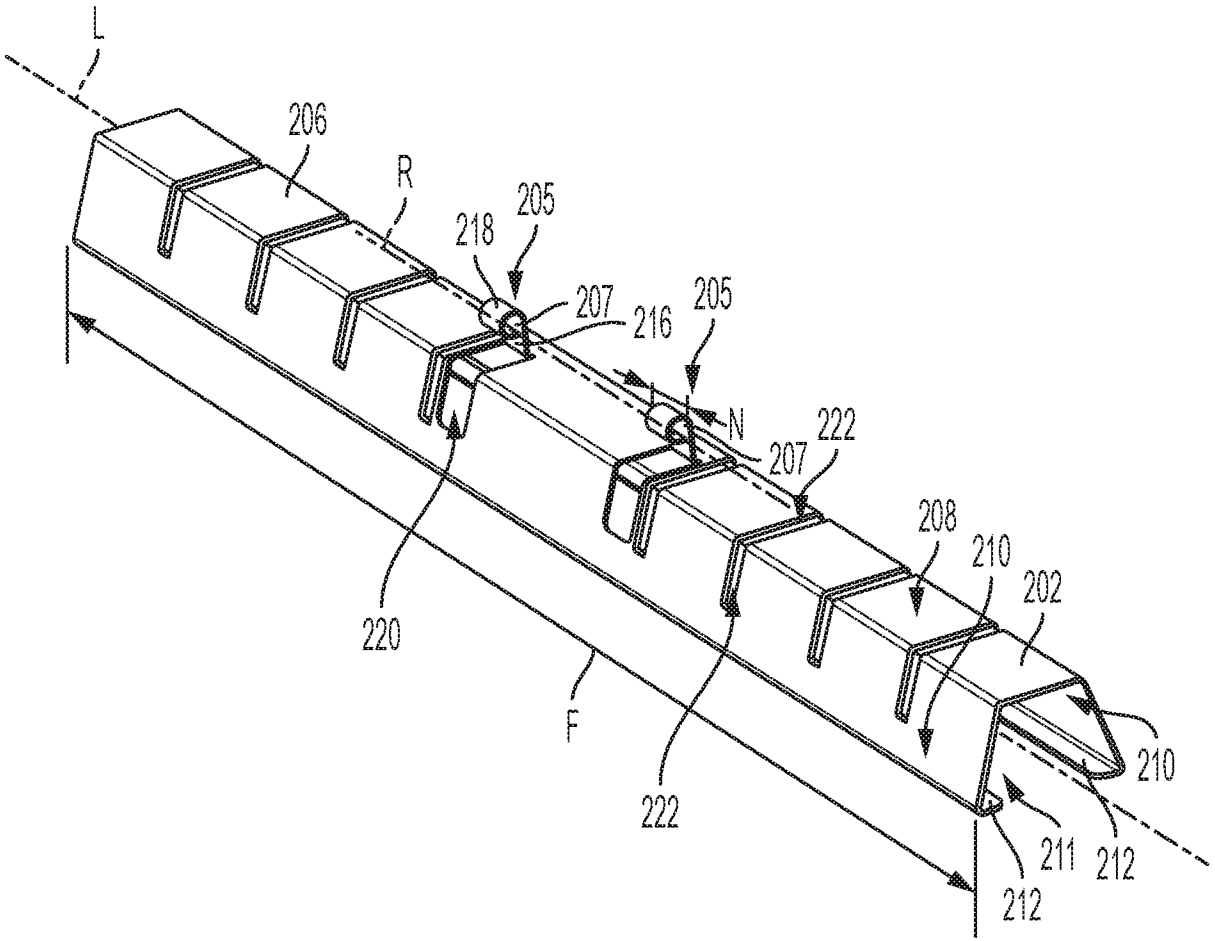
FIG. 4 is an outline view of a refill channel with surrounding structures removed for illustration in accordance with the invention.

As can be seen in FIGS. 1-3, the insert 102 essentially includes a rail 202 and a cleaning element 204. The exemplary cleaning element 204 is shown as a sponge, but it should be appreciated that many other types and combinations of materials may be used to construct a cleaning element such as the cleaning element 204, for example, a combination of different types of sponges, scrubbers, cloth, and the like. As shown in FIG. 4, the rail 202 includes two protrusions 205, each forming an actuation bore 207. When the mop 100 is assembled, the tines 126 are disposed within the actuation bores 207, and the channel is positioned between the rollers 116 (see FIG. 2). When the user rotates the hand lever 118, the pair of pull bars 122 are retracted relative to the receptacle 114. Retraction of the pull bars 122 also operates to pull the tines 126 along the longitudinal axis A in a direction towards the top end 106 of the handle 104. While the tines 126 are engaged within the actuation bores 207, upward movement of the tines 126 also pulls the insert 202 upward such that the cleaning element 204 passes through the rollers 116 and is compressed thereby, thus wringing liquid that may be present therein. Upon reversal of the hand lever 118, the pair of pull bars 122 and tines 126 extend in a direction towards the bottom end 110 of the handle 104, and the cleaning element 204 again passes through and rests in a position past the rollers 116 where it can contact the floor for cleaning.

Figure 6:
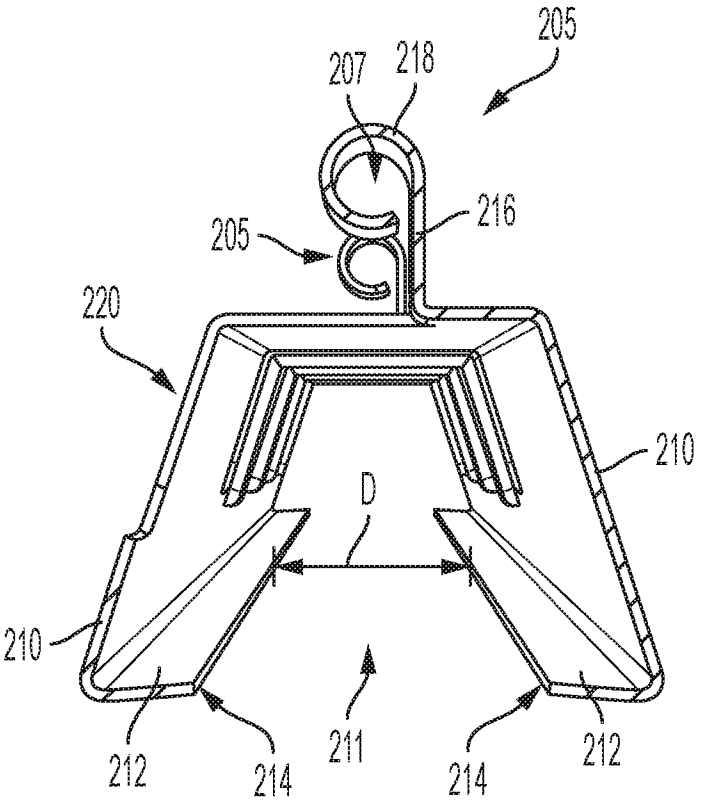
FIG. 6 is a cross section view of the refill channel of FIG. 5.
Figure 5:
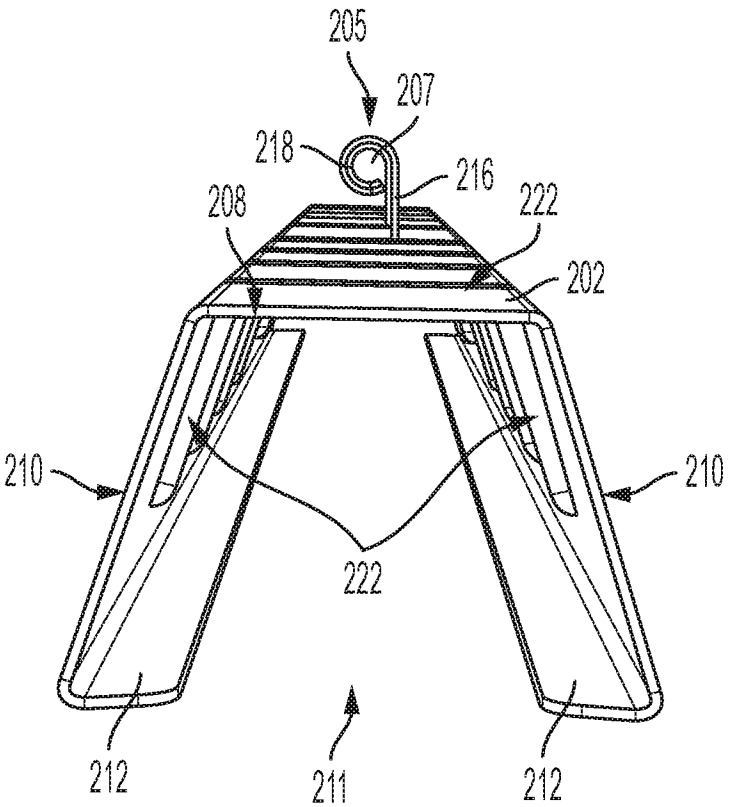
FIG. 5 is a front view along the refill channel of FIG. 4.

Turning now to the views shown in FIG. 4, where the rail 202 is shown removed from the surrounding structures for illustration, and also the views shown in FIGS. 5 and 6, where a side view of the rail 202 is shown in full and sectioned views, it can be seen that the rail 202 has an elongate shape that extends along a major axis L. The rail 202 is made from an elongate body 206 having a generally U-shaped cross sectional shape that is made from a top wall 208 and two sidewalls 210. The top wall 208 and sidewalls 210 surround on three sides an internal channel 211, which is occupied by a portion of the cleaning element 204 when the insert 102 is assembled (see, e.g., FIG. 3). In the illustrated embodiment, two bottom wall portions 212 extend from a free edge of each sidewall 210 to partially surround or enclose the internal channel 211 opposite the top wall 208 along an entire length of the rail 202. The wall portions 212 help retain the cleaning element 204 in its engaged condition with the rail 202 during a cleaning operation by pinching the cleaning element 204 within a slot 214 having a width, D, that remains between innermost edges or faces of the wall portions 212 as shown, for example, in FIG. 6.

In the illustrated embodiment, the body 206 is made from sheet metal material, which is formed in a desired shape, for example, using dies, a bending brake, and other forming equipment or operations. Accordingly, in one embodiment, the actuation bores 207 in the protrusions 205 are formed by first severing a strip of material extending at least partially along the top wall 208 and one of the sidewalls 210, then bending the strip upwards and away from the top wall 208 to form a leg 216 before curling an end portion of the strip into a cylindrical wall 218 that defines therein or surrounds the bore 207. The bores 207 extend along the same axis, R, which is parallel and offset from the axis L. A plane defined by the axes R and L will also bifurcate the slot 214 between the partial walls 212. The cutting operation that forms the strips may leave a window or opening 220, which can help retain the cleaning element 204 in the internal channel 211 (by allowing a portion of the sponge material to bulge from the opening) as well as provide a pathway for fluids to flow into or out from the cleaning element 204. As can be appreciated, while both protrusions 205 are shown in the embodiment of FIG. 4 to be formed by strips cut into the top wall 208 and the same sidewall 212, the strips may alternatively be cut in different sidewalls to provide a more symmetrical insert 202.

The two protrusions 205 are spaced apart along the length of the body 206 and, together, occupy about a middle third of the length, F, of the rail 202 along the axis L. As can be appreciated, stresses in the body 206 may be present while a wringing operation is carried out, especially in the two portions of the body 206 that are at the axial ends of the body 206 and extend away from the protrusions 205, from the where the rail 202 is supported onto the mop 100. To help support loading, each actuation bore 205 extends over a length, N, that overlaps a substantial portion, or even an entire length of the corresponding tine 126, such that load transferred through the cylindrical walls 218 and legs 216 to the body 206 is distributed along a larger area.

To stiffen the rail 202 such that it can resist bending and torsional loads that may occur during use, the body 206 includes a plurality of transverse channels 222, which in the illustrated embodiment extend along the top wall 208 and at least partially down both sidewalls 210 in a direction perpendicular to the axis L. In addition to stiffening the rail 202, the channels 222 are formed by pressing into the body 206 such that internal dimples are formed (see FIGS. 5 and 6) that even further help retain the cleaning element 204 into the internal channel 211 of the rail 202. Stiffness of the rail 202 is also augmented by use of steel sheets to form the body 206.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An insert for a mop, comprising:

a rail having a body, the body having an elongate shape and forming an internal channel, a cleaning element at least partially disposed in the internal channel in engaged relation with the body, wherein the cleaning element is made from one or more sponge materials disposed within the internal channel and extending therefrom;

two protrusions disposed on the body, each of the two protrusions forming a leg connected to the body and a cylindrical wall defining an actuation bore connected to the leg;

wherein each actuation bore is adapted to overlap a substantial portion of a tine, the tine being associated with a sponge mop having a hand lever that operates to pull the tine, the tine being disposed in the actuation bore and configured to impart a force onto the body through the actuation bore to pull the rail and the cleaning element through a set of rollers to wring out fluids that may be present in the cleaning element.

2. The insert of claim 1, wherein the body has a generally U-shaped cross sectional shape.

3. The insert of claim 2, wherein the body is made from a top wall and two sidewalls that surround on three sides the internal channel.

4. The insert of claim 3, further comprising two bottom wall portions extending from a free edge of each of the two sidewalls to partially enclose an opening of the internal channel opposite the top wall along an entire length of the rail.

5. The insert of claim 4, wherein the two bottom wall portions form a slot therebetween that pinches the cleaning element.

6. The insert of claim 1, wherein the body is made from sheet metal material, which is formed in a desired shape.

7. The insert of claim 6, wherein the actuation bores in the protrusions are formed by:

severing a strip of material extending at least partially along a top wall and one of two sidewalls of the body;

bending the strip away from the top wall to form the leg; and curling an end portion of the strip into the cylindrical wall that surrounds a respective actuation bore.

8. The insert of claim 7, wherein the actuation bores are aligned and extend along an axis that is parallel and offset from a longitudinal axis of the body.

9. The insert of claim 8, wherein an imaginary plane defined by the axis along which the actuation bores extend and the longitudinal axis of the body bifurcates the internal channel.

10. The insert of claim 7, wherein an operation that forms the strips leaves a window in the body adjacent the leg and below the cylindrical wall.

11. The insert of claim 7, wherein both strips are cut from the same sidewall.

12. The insert of claim 1, wherein the two protrusions are spaced apart along a length of the body and, together, occupy about a middle third of the length of the body.

13. The insert of claim 12, further comprising a plurality of transverse channels formed in the body and extending along the top wall and at least partially down the two sidewalls in a direction perpendicular to a longitudinal axis of the body.

14. The insert of claim 13, wherein the transverse channels are formed by a pressing operation such that internal dimples are formed on the two sidewalls internally along the internal channel.

* * * * *